US007488908B2

(12) United States Patent
Beerling

(10) Patent No.: US 7,488,908 B2
(45) Date of Patent: Feb. 10, 2009

(54) LIQUID METAL SWITCH EMPLOYING A SWITCHING MATERIAL CONTAINING GALLIUM

(75) Inventor: Timothy Beerling, San Francisco, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 527 days.

(21) Appl. No.: 11/254,906

(22) Filed: Oct. 20, 2005

(65) Prior Publication Data

US 2007/0089975 A1 Apr. 26, 2007

(51) Int. Cl.
*H01H 29/00* (2006.01)

(52) U.S. Cl. ..... 200/182

(58) Field of Classification Search ..... 200/182–194, 200/214, 229, 233, 220; 335/78; 361/277, 361/278, 271; 310/328, 333, 344; 385/9, 385/19, 147

See application file for complete search history.

(56) References Cited

U.S. PATENT DOCUMENTS

| | | | | |
|---|---|---|---|---|
| 2,251,316 | A | 8/1941 | Bear et al. | |
| 6,706,980 | B1 * | 3/2004 | Narasimhan | 200/61.47 |
| 6,774,325 | B1 * | 8/2004 | Wong et al. | 200/182 |
| 6,781,074 | B1 | 8/2004 | Fong et al. | |
| 6,787,720 | B1 * | 9/2004 | Wong | 200/182 |
| 6,906,271 | B2 * | 6/2005 | Fong et al. | 200/182 |
| 6,924,443 | B2 * | 8/2005 | Wong et al. | 200/182 |
| 7,005,593 | B2 * | 2/2006 | Gasparyan et al. | 200/182 |
| 7,071,432 | B2 * | 7/2006 | Lindsey | 200/182 |
| 7,132,614 | B2 * | 11/2006 | Beerling | 200/182 |
| 7,158,363 | B2 * | 1/2007 | Beerling | 361/278 |
| 7,183,509 | B2 * | 2/2007 | Beerling | 200/181 |
| 7,211,754 | B2 * | 5/2007 | Wang et al. | 200/182 |
| 7,268,310 | B2 * | 9/2007 | Beerling | 200/182 |
| 2004/0037708 | A1 | 2/2004 | Murasato et al. | |
| 2004/0055857 | A1 | 3/2004 | Narasimhan | |

OTHER PUBLICATIONS

E. G. Mal'chevskii, L. L. Migai and V. V. Patrikeev; Stability of Gallium-Indium-Tin Alloy In Contact Devices; Elektrotekhnika, vol. 52, No. 6, pp. 62-63, 1981.

T. B. Jones; An Electromechanical Interpretation of Electrowetting; Dept. of Electical and Computer Engineering, University of Rochester, Rochester, NY 14627, USA, 2005, pp. 1184-1187.

* cited by examiner

*Primary Examiner*—Michael A Friedhofer

(57) ABSTRACT

A liquid metal switch uses a conductive liquid droplet of a material containing gallium as a substitute for mercury. A secondary fluid surrounding the material containing gallium prevents the formation of oxide on a surface of the conductive liquid droplet.

20 Claims, 5 Drawing Sheets

LIQUID METAL SWITCH EMPLOYING A SWITCHING MATERIAL CONTAINING GALLIUM

BACKGROUND

Many switching technologies rely on solid, mechanical contacts that are alternatively actuated from one position to another to make and break electrical contact. Unfortunately, mechanical switches that rely on solid-solid contact are prone to wear and are subject to a condition known as "fretting." Fretting refers to erosion that occurs at the points of contact on surfaces. Fretting of the contacts is likely to occur under load and in the presence of repeated relative surface motion. Fretting typically manifests as pits or grooves on the contact surfaces and results in the formation of debris that may lead to shorting of the switch or relay.

To reduce mechanical damage imparted to switch and relay contacts, switches and relays may be fabricated using liquid metals to wet the movable mechanical structures to prevent solid to solid contact. A liquid metal switch that employs electrowetting to actuate the switch is disclosed in, commonly assigned, U.S. Pat. No. 7,132,614, entitled "Liquid Metal Switch Employing Electrowetting For Actuation And Architectures For implementing Same," which is incorporated herein by reference. Another liquid metal switch that employs gas pressure to actuate the switch is disclosed in, commonly assigned, U.S. Pat. No. 7,164,090, entitled "Liquid Metal Switch Employing A Single Volume Of Liquid Metal," which is also incorporated herein by reference. The liquid metal switches described in the above-mentioned applications use mercury (Hg) as the liquid metal. However, the use of mercury is being limited in some areas due to environmental and health related initiatives.

SUMMARY OF THE INVENTION

In accordance with the invention, a liquid metal switch uses a conductive liquid droplet of a material containing gallium as a substitute for mercury. A secondary fluid surrounding the material containing gallium prevents the formation of oxide on a surface of the conductive liquid droplet.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The use of a gallium-based alloy in a liquid metal switch as the switching element alleviates the restrictions imposed by the use of a potentially toxic material, such as mercury. However, the use of a gallium-based alloy also poses challenges. One of the main challenges is that the heat of formation of oxides for gallium and gallium-based alloys is high. This means that merely replacing mercury with gallium or a gallium-based alloy in a liquid metal switch would likely result in the formation of gallium oxides on the surface of the gallium or gallium-based alloy. Because the heat of formation of mercury oxides is very low, oxide formation on the mercury is not particularly problematic. However, because the heat of formation of gallium oxides is very high, in the presence of air, oxides readily form on the surface of the gallium or gallium-based alloy and would likely result in a change in the surface tension, or even the formation of a solid "crust" on the surface. This impedes movement of the gallium or gallium-based alloy, thereby limiting the performance of the switch.

Therefore, in an embodiment in accordance with the invention, a secondary fluid replaces air as the ambient atmosphere surrounding a gallium or gallium-based alloy in a liquid metal switch. The secondary fluid prevents oxidation of the gallium-based alloy surface, by preventing oxygen from reaching the gallium-based alloy surface, and/or by reducing oxides that form on the gallium-based alloy surface. The secondary fluid is typically non-corrosive with respect to the gallium or the gallium-based alloy, and is typically non-conductive (i.e., a dielectric). In addition, the secondary fluid should typically not influence the switching properties of the liquid metal and should typically have a low viscosity relative to the gallium or gallium-based alloy. Further, the secondary fluid should typically be wetting with respect to the microfluidic chambers that form the switch and fluid loading regions.

While described below as being used in a liquid metal switch that uses electrowetting or gas pressure to actuate the switch, the liquid metal switch employing a switching material containing gallium can be used in any liquid metal switching application, independent of actuation methodology.

Figure 1A:
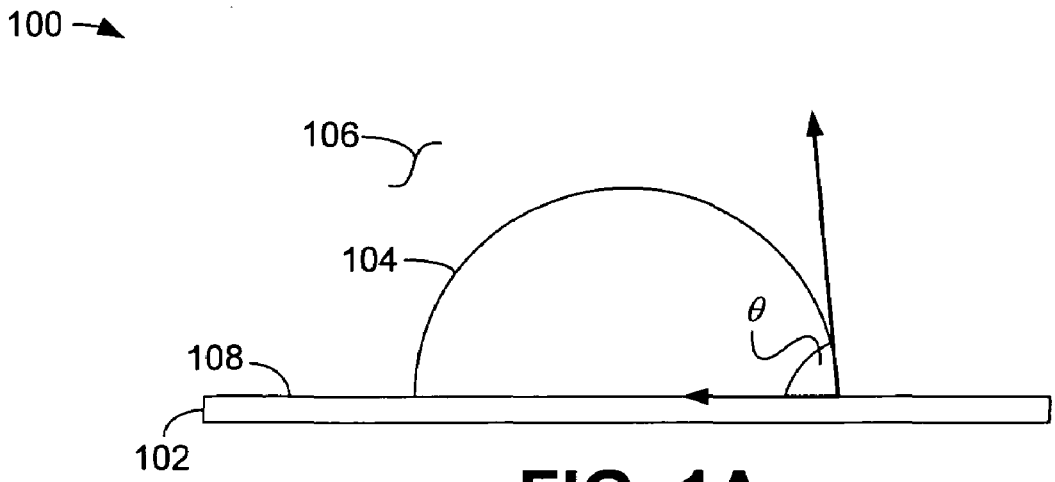
FIG. 1A is a schematic diagram illustrating an embodiment of a system including a droplet of conductive liquid residing on a solid surface.

Prior to discussing embodiments in accordance with the invention, a brief discussion on the effect of electrowetting will be provided. FIG. 1A is a schematic diagram illustrating a system 100 including a droplet of conductive liquid residing on a solid surface. The droplet 104 can be, for example, a gallium-based alloy containing, for example, gallium, indium, tin, zinc, copper, or a combination of these elements with gallium. The droplet 104 resides on a surface 108 of a solid 102. A contact angle, also referred to as a wetting angle, is formed where the droplet 104 meets the surface 108. The contact angle is indicated as θ and is measured at the point at which the surface 108, liquid 104 and gas 106 meet. The gas 106 can be, in this example, a fluid that prevents the formation of oxides on the surface of the droplet 104. The fluid 106 forms the atmosphere surrounding the droplet 104. A high contact angle, as shown in FIG. 1A, is formed when the droplet 104 contacts a surface 108 that is referred to as relatively non-wetting, or less wettable. The wettability is generally a function of the material of the surface 108 and the material from which the droplet 104 is formed, and is specifically related to the surface tension of the liquid. Typically, the fluid 106 is wetting with respect to the surface 108, and to the walls and roof (to be described below) of a switch structure that contains the droplet 104 in a fluid channel, or fluid cavity.

Figure 1B:
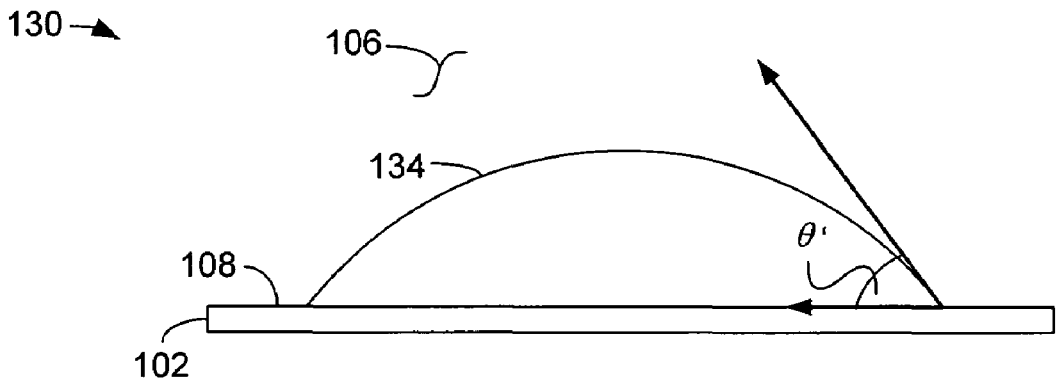
FIG. 1B is a schematic diagram illustrating the system of FIG. 1A having a different contact angle.

FIG. 1B is a schematic diagram 130 illustrating the system 100 of FIG. 1A having a different contact angle. In FIG. 1B, the droplet 134 is more wettable with respect to the surface 108 than the droplet 104 with respect to the surface 108, and therefore forms a lower contact angle, referred to as θ". As shown in FIG. 1B, the droplet 134 is flatter and has a lower profile than the droplet 104 of FIG. 1A.

The concept of electrowetting, which is defined as a change in contact angle with the application of an electrical potential, relies on the ability to electrically alter the contact angle that a conductive liquid forms with respect to a surface with which the conductive liquid is in contact. Typically, the contact angle between a conductive liquid and a surface with which it is in contact ranges between 0° and 180°.

Figure 2A:
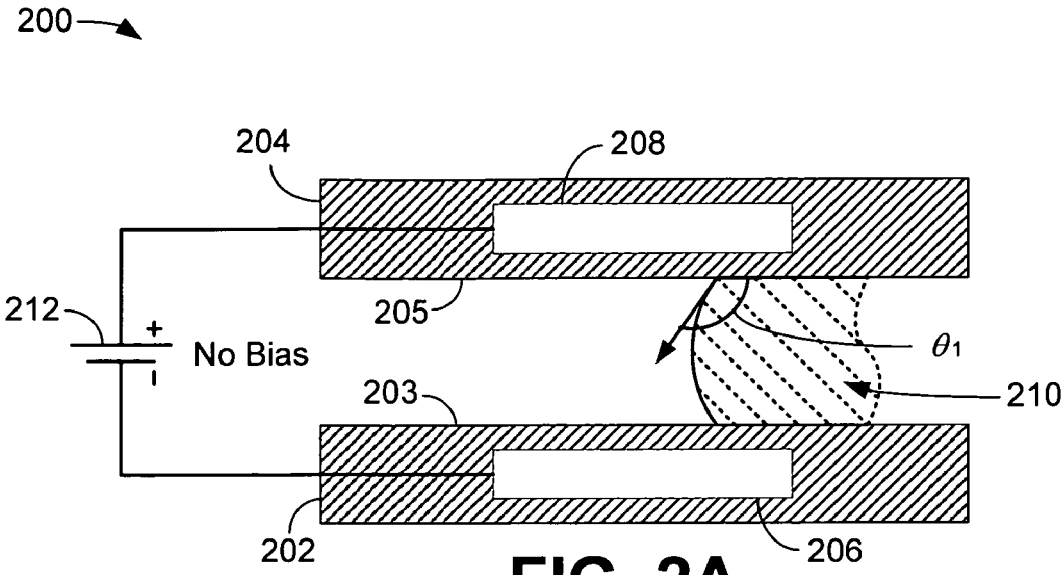
FIG. 2A is a schematic diagram illustrating one manner in which electrowetting can alter the contact angle between a droplet of conductive liquid and a surface that it contacts.

FIG. 2A is a schematic diagram 200 illustrating one manner in which electrowetting can alter the contact angle between a droplet of conductive liquid and a surface that the droplet contacts. In FIG. 2A, a droplet 210 of conductive liquid is sandwiched between dielectric 202 and dielectric 204. The dielectric can be, for example, tantalum oxide, or another dielectric material. An electrode 206 is buried within dielectric 202 and an electrode 208 is buried within dielectric 204. The electrodes 206 and 208 are coupled to a voltage source 212. In FIG. 2A, the system is electrically non-biased. Under this non-biased condition, the droplet 210 forms a contact angle, referred to as $\theta_1$, with respect to the surface 205 of the dielectric 204 that is in contact with the droplet 210. A similar contact angle exists between the droplet 210 and the surface 203 of the dielectric 202.

Figure 2B:
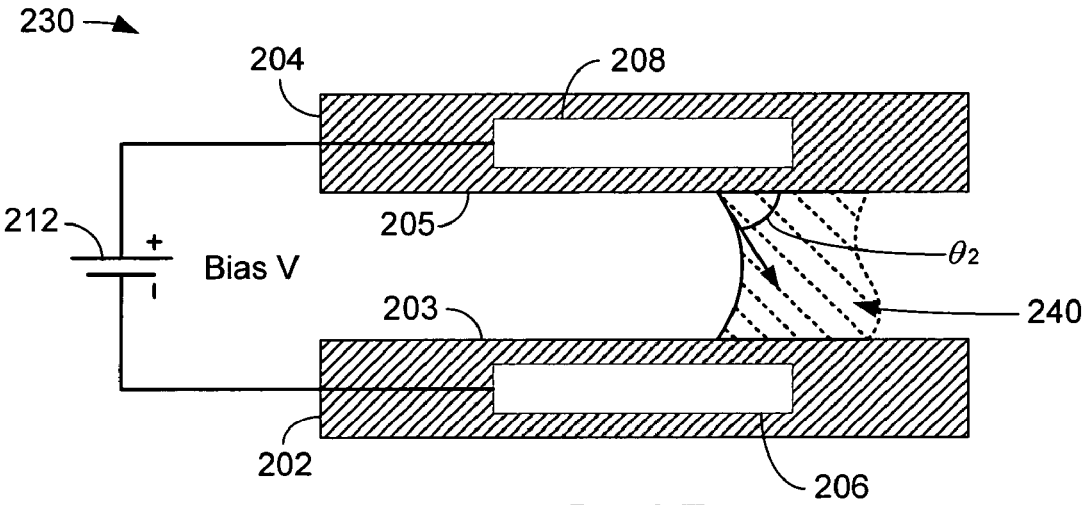
FIG. 2B is a schematic diagram illustrating the system of FIG. 2A under an electrical bias.

FIG. 2B is a schematic diagram 230 illustrating the system 200 of FIG. 2A under an electrical bias. The voltage source 212 provides a bias voltage to the electrodes 206 and 208. The voltage applied to the electrodes 206 and 208 creates an electric field through the conductive liquid droplet causing the droplet to move. The movement of the droplet 210 increases the capacitance of the system, thus increasing the energy of the system. In this example, the contact angle of the droplet 240 is altered with respect to the contact angle of the droplet 210. The new contact angle is referred to as $\theta_2$, and is a result of the electric field created between the electrodes 206 and 208 and the droplet 240.

It is typically desirable to isolate the droplet from the electrodes, and thus allow the droplet to become part of an electrical circuit. The application of an electrical bias as shown in FIG. 2B, appears to make the surface 205 of the dielectric 204 and the surface 205 of the dielectric 202 more wettable with respect to the droplet 240 than the no-bias condition shown in FIG. 2A. Although the surface tension of the liquid that forms the droplet 240 typically resists any deformation of the liquid surface caused by the electrowetting effect, the contact angle changes as a result of the creation of the electric field between the electrodes 206 and 208. As will be described below, the change in the contact angle alters the curvature of the droplet and leads to translational movement of the droplet.

Figure 3A:
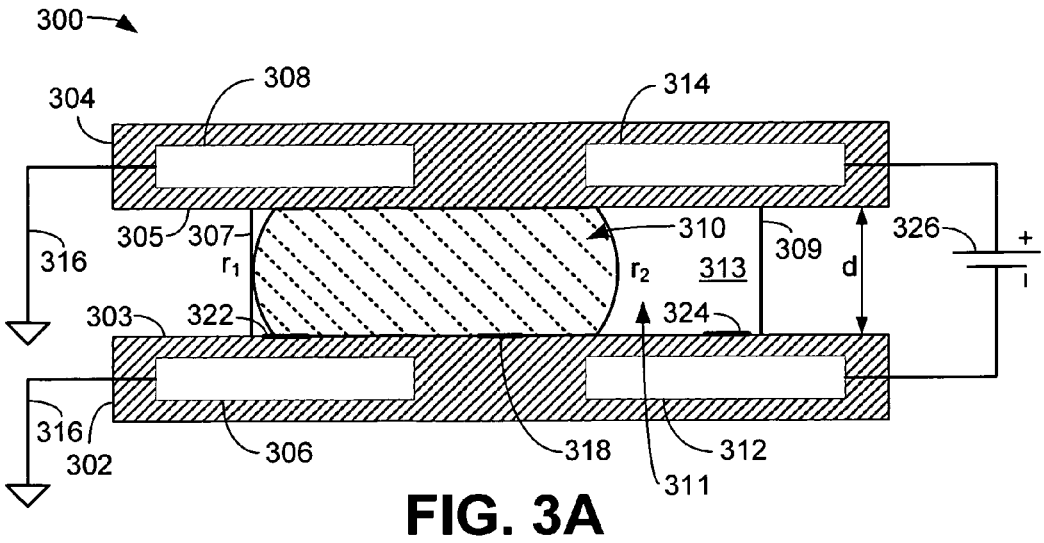
FIG. 3A is a schematic diagram illustrating an embodiment of an electrical switch employing a conductive liquid droplet.

FIG. 3A is a schematic diagram illustrating an embodiment of an electrical switch 300 employing a gallium-based conductive liquid droplet. The switch 300 includes a dielectric 302 having a surface 303 forming the floor of the switch, and a dielectric 304 having a surface 305 that forms the roof of the switch. Shown schematically are wall portions 307 and 309 that, together with the surface 303 and surface 305, form a fluid cavity 311. A droplet 310 of a conductive liquid is sandwiched between the dielectric 302 and the dielectric 304.

The area remaining within the fluid cavity 311 is filled with a secondary fluid 313. The secondary fluid 313 forms the atmosphere around the droplet 310. Typically, the secondary fluid 313 reduces or eliminates the formation of oxides on the surface of the droplet 310. For many gallium alloys, a secondary fluid 313 having a pH of approximately 10 will result in a hydroxyl (OH) ion terminated surface, rather than a thin native oxide terminated surface (e.g. $Ga_2O_3$), that can otherwise form and lead to the undesirable effects mentioned above. The secondary fluid 313 also typically possesses non-conductive dielectric characteristics so as to not interfere with the electrowetting effect that causes the droplet 310 to translate in the fluid cavity 311. However, with an alkaline solution there will be ionic conductivity, and this conductivity should be sufficiently small so as not to cause unacceptable leakage currents in the switch. Typically, the secondary fluid 313 should typically have a low microwave loss tangent, enabling the secondary fluid 313 to maintain its dielectric properties at high radio frequencies. Further, the interface energy between the gallium-based droplet 310 and the secondary fluid 313 should be such that switching action can still occur. The secondary fluid 313 should also be of sufficiently low viscosity so as not to unacceptably slow switching times. The secondary fluid should be wetting with respect to the surfaces 303 and 305, and with respect to the surfaces of the wall portions 307 and 309, so that the secondary fluid 313 can be loaded into the switch by capillary action.

Although omitted for clarity in FIG. 3A, the fluid cavity 311 also includes one or more vents that are used to load the liquid metal and the secondary fluid into the fluid cavity 311. The vents can be sealed after the introduction of the liquid metal and the secondary fluid. The liquid metal can be loaded into the fluid cavity 311 as described in co-pending, commonly-assigned published U.S. patent application No. 2006/0260919, entitled "Method and Apparatus for Filling a Microswitch with Liquid Metal," which is incorporated herein by reference. The secondary fluid is typically wetting with respect to the surfaces 303, 305 and the wall portions 307 and 309 to facilitate loading the secondary fluid into the fluid cavity 311.

The dielectric 302 includes an electrode 306 and an electrode 312. The dielectric 304 includes an electrode 308 and an electrode 314. The electrodes 306 and 312 are buried within the dielectric 302 and the electrodes 308 and 314 are buried within the dielectric 304. In this example, and to induce the droplet 310 to move toward the electrodes 312 and 314, the electrodes 306 and 308 are coupled to an electrical return path 316 and are electrically isolated from electrodes 312 and 314, and the electrodes 312 and 314 are coupled to a voltage source 326. Alternatively, to induce the droplet 310 to move toward the electrodes 306 and 308, the electrodes 312 and 314 can be coupled to an isolated electrical return path and the electrodes 306 and 308 can be coupled to a voltage source.

In this example, the switch 300 includes electrical contacts 318, 322, and 324 positioned on the surface 303 of the dielectric 302. In this example, the contact 318 can be referred to as an input, and the contacts 322 and 324 can be referred to as outputs. As shown in FIG. 3A, the droplet 310 is in electrical contact with the input contact 318 and the output contact 322. Further, in this example, the droplet 310 will always be in contact with the input contact 318.

As shown in FIG. 3A as a cross section, the droplet 310 includes a first radius, $r_1$, and a second radius, $r_2$. When electrically unbiased, i.e., when there is zero voltage supplied by the voltage source 326, the curvature of the radius $r_1$ equals the curvature of the radius $r_2$ and the droplet is at rest. The radius of curvature, r, of the droplet is defined as $$r = \frac{d}{\cos\theta_{top} + \cos\theta_{bottom}} \quad \text{Eq. (1)}$$

where d is the distance between the surface 303 of the dielectric 302 and the surface 305 of the dielectric 304, $\cos\theta_{top}$ is the contact angle between the droplet 310 and the surface 305, and $\cos\theta_{bottom}$ is the contact angle between the droplet 310 and the surface 303. Therefore, as shown in FIG. 3A, the droplet 310 is at rest whereby the radius $r_1$ equals the radius $r_2$, where the curvatures are in opposing directions.

Upon application of an electrical potential via the voltage source 326, a new contact angle between the droplet 310 and the surfaces 303 and 305 is defined. The following equation defines the new contact angle.

$$\cos\theta(V) = \cos\theta_o + \frac{\varepsilon}{2\gamma t}V^2 \quad \text{Eq. (2)}$$

Equation 2 is referred to as Young-Lipmann's Equation, where the new contact angle, $\cos\theta$ (V), is determined as a function of the applied voltage. In equation 2, $\in$ is the dielectric constant of the dielectrics 302 and 304, $\gamma$ is the surface tension of the liquid, t is the dielectric thickness, and V is the voltage applied to the electrode with respect to the conductive liquid. Therefore, to change the contact angle of the droplet 310 with respect to the surfaces 303 and 305 a voltage is applied to electrodes 314 and 312, thus altering the profile of the droplet 310 so that $r_1$ is not equal to $r_2$. If $r_1$ is not equal to $r_2$, then the pressure, P, on the droplet 310 changes according to the following equation.

$$P = \gamma\left(\frac{1}{r_1} + \frac{1}{r_2}\right) \quad \text{Eq. (3)}$$

Figure 3B:
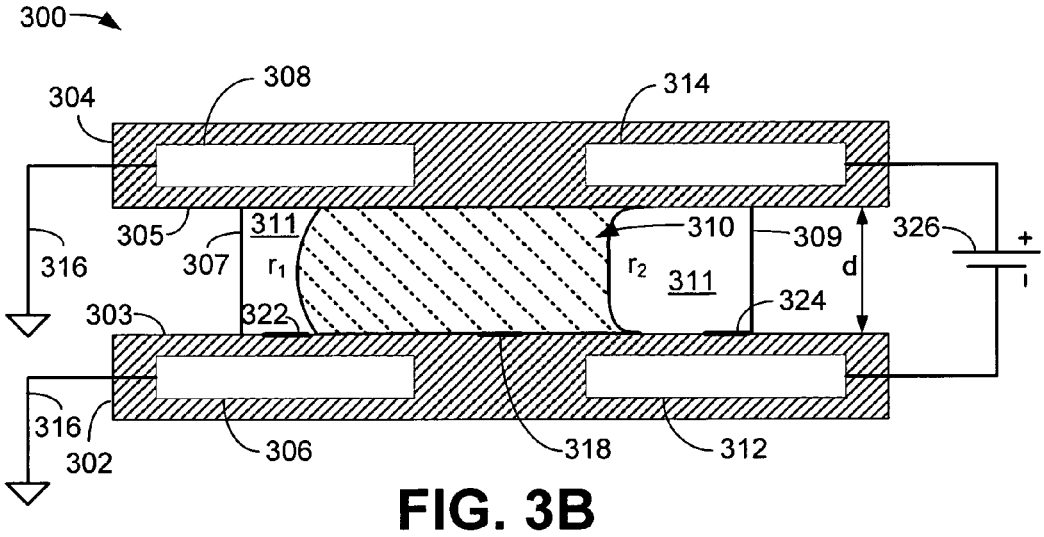
FIG. 3B is a schematic diagram illustrating the movement imparted to a droplet of conductive liquid as a result of the change in contact angle due to electrowetting.

FIG. 3B is a schematic diagram illustrating the movement imparted to a droplet of conductive liquid as a result of the pressure change of the droplet 310 caused by the reduction in contact angle due to electrowetting. When a voltage is applied to the electrodes 314 and 312 by the voltage source 326, the contact angle of the droplet 310 with respect to the surfaces 303 and 305 in FIG. 3A is reduced so that $r_1$ does not equal $r_2$. When the radii $r_1$ and $r_2$ differ, a pressure differential is induced across the droplet, thus causing the droplet to translate across the surfaces 303 and 305.

Figure 3C:
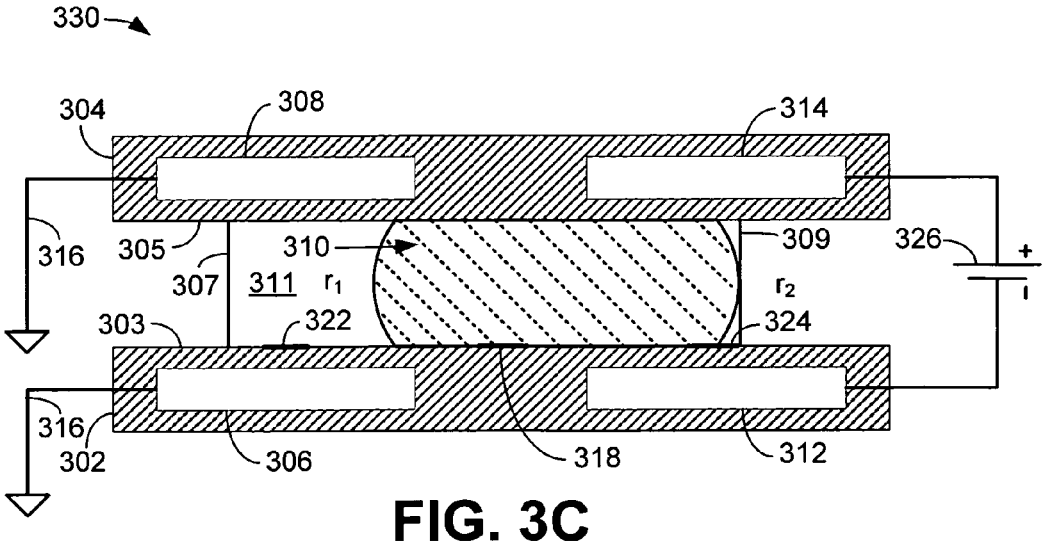
FIG. 3C is a schematic diagram illustrating the switch of FIG. 3A after the application of an electrical potential.

FIG. 3C is a schematic diagram 330 illustrating the switch 300 of FIG. 3A after the application of a voltage. As shown in FIG. 3C, the droplet 310 has moved and now electrically connects the input contact 318 and the output contact 324. In this manner, electrowetting can be used to induce translational movement in a conductive liquid and can be used to switch electronic signals.

In another embodiment in accordance with the invention, the secondary fluid 313 can be designed to draw contamination away from the surface of the liquid metal droplet with which it is in contact. For example, some types of contamination manifest in the bulk of the liquid metal and other types of contamination manifest at the surface of the liquid metal droplet. Surface contamination can alter the surface tension, and therefore, the mobility and switching characteristics, of the liquid metal droplet. The secondary fluid 313 can be designed to capture and place into solution contamination that migrates to the surface of the liquid metal droplet. The selection of the secondary fluid 313 will depend on the type of contaminants sought to be captured and placed into solution.

Figure 4A:
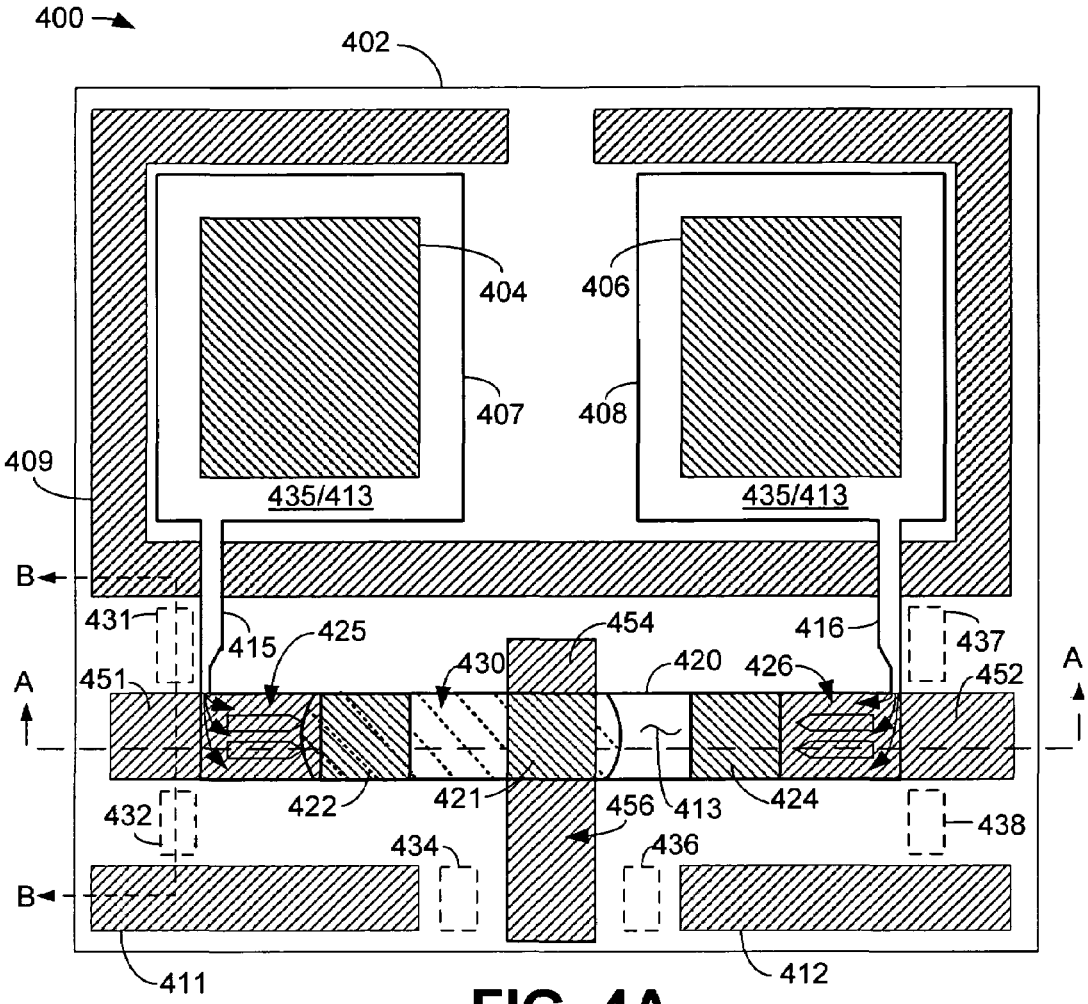
FIG. 4A is a schematic diagram illustrating a micro circuit according to an embodiment of the invention.

In another embodiment in accordance with the invention, the gallium-based liquid metal switch is implemented in a liquid metal microswitch that uses gas pressure to cause translation of the liquid metal droplet. FIG. 4A is a schematic diagram illustrating a micro circuit 400. In this example, the micro circuit 400 can be a liquid metal micro-switch. The liquid metal micro-switch 400 is fabricated on a substrate 402 that may include one or more layers (not shown). For example, the substrate 402 can be partially covered with a dielectric material (not shown) and other material layers. The liquid metal micro-switch 400 can be a fabricated structure using, for example, thin film deposition techniques and/or thick film screening techniques that could comprise either single layer or multi-layer circuit substrates.

The liquid metal micro-switch 400 includes heaters 404 and 406. The heater 404 resides within a heater cavity 407 and the heater 406 resides within a heater cavity 408. The liquid metal micro-switch 400 also includes a cover, or cap, which is omitted from FIG. 4A The cavities 407 and 408 can be filled with a gas, which can be, for example, nitrogen ($N_2$) and which is illustrated using reference numeral 435. Alternatively, the cavities 407 and 408 can be filled with a secondary fluid 413 that is similar to the secondary fluid 313 described above. The heater cavity 407 is coupled via a sub-channel 415 to a main channel 420. The main channel 420 is also referred to as a fluid cavity. Similarly, the heater cavity 408 is coupled via sub-channel 416 to the main channel 420. The main channel 420 is partially filled with a single droplet 430 of liquid metal. However, in some applications, there may be two separate droplets of conductive liquid that are divided by gas pressure to actuate the switching function. The droplet 430 is sometimes referred to as a "slug." The liquid metal, which can be, for example, a gallium-based alloy containing gallium and indium, tin, zinc and copper, or a combination thereof, is in constant contact with an input contact 421 and one of two output contacts 422 and 424. The droplet 430 is surrounded in the main channel 420 by the secondary fluid 413.

A portion 451 of metallic material underlying the contact 422 extends past the periphery of the main channel 420 onto the substrate 402. Similarly, a portion 452 of metallic material underlying the output contact 424 extends past the periphery of the main channel 420 onto the substrate 402, and portions 454 and 456 of the metallic material underlying the input contact 421 extend past the periphery of the main channel 420 onto the substrate 402. The metal portions 451, 452, 454 and 456 are generally covered by a dielectric, which is omitted from FIG. 4A for simplicity of illustration. Metallic material is also deposited, or otherwise applied to the substrate 402 approximately in regions 409, 411 and 412 to provide metal bonding capability to attach a cap, if desired. The cap, also referred to as a cover that defines walls and a roof, will be described below. Bonding the roof to the switch 400 may also be accomplished by anodic bonding, in which case the regions 409, 411 and 412 would include a layer of amorphous silicon. The output contacts 422 and 424 are typically fabricated as small as possible to minimize the amount of energy used to separate the droplet 430 from the output contact 422 or from the output contact 424 when switching is desired.

Further, minimizing the area of the contacts 421, 422 and 424 further improves electrical isolation among the contacts by minimizing the likelihood of capacitive coupling between the droplet 430 and the contact with which the droplet is not in physical contact.

The main channel 420 includes a feature 425 and a feature 426 as shown. The features 425 and 426 can be fabricated on the surface of the substrate 402 as, for example, islands that extend upward from the base of the main channel 420 and that contact the edge of the liquid metal droplet 430 as shown. These features 425 and 426 may also be defined as part of the cover that defines the sidewalls and roof of the channel 420. The features 425 and 426 determine the at-rest position of the liquid metal droplet 430. To effect movement of the liquid metal droplet 430 and therefore perform a switching function, one of the heaters 404 or 406 heats the gas 435 in the heater cavity 407 or 408 causing the gas 435 to expand and travel through one of the sub-channels 415 or 416. The expanding gas 435 exerts pressure on the droplet 430, causing the droplet 430 to translate through the main channel 420. When the position of the droplet 430 is as shown in FIG. 4A, the heater 404 heats the gas 435 in the heater cavity 407, thus expanding and forcing the gas through the sub-channel 415 and around the feature 425 so that a relatively constant wall of pressure is exerted against the droplet 430. The gas pressure thus exerted causes the droplet to move towards the output contact 424. The feature 425 and the feature 426 prevent the droplet 430 from extending past a definable point in the main channel 420, but allow the droplet 430 to easily de-wet from the features 425 and 426 when movement of the droplet 430 is desired. When the cavity 407 and the cavity 408 are filled with the secondary fluid 413, to perform the switching function one of the heaters 404 or 406 boils the secondary fluid 413. The motion of the expanding boiled secondary fluid 413 in the vicinity of the heater 404 or 406 causes a bubble to form. The pressure of the expanding bubble on the surrounding unboiled secondary fluid 413 then imparts work on the droplet 430, causing the droplet 430 to translate through the main channel 420 and cause switching to occur.

Further, because a single droplet 430 is used in the micro-switch 400, the likelihood that the droplet 430 will fragment into microdroplets that may enter the sub-channels 415 and 416 is significantly reduced when compared to a switch in which the liquid metal droplet is divided into multiple segments to provide the switching action.

Although omitted for clarity in FIG. 4A, the main channel 420 also includes one or more vents that are used to load the liquid metal into the main channel 420. The vents can be sealed after the introduction of the liquid metal and the secondary fluid.

The main channel 420 also includes one or more defined areas that include surfaces that can alter and define the contact angle between the droplet 430 and the main channel 420. A contact angle, also referred to as a wetting angle, is formed where the droplet 430 meets the surface of the main channel 420. The contact angle is measured at the point at which the surface, liquid and secondary fluid meet. The secondary fluid can be, in this example, amino alcohol triethanol amine, another organic alcohol, or another secondary fluid that forms the atmosphere surrounding the droplet 430. A high contact angle is formed when the droplet 430 contacts a surface that is referred to as relatively non-wetting, or less wettable. The wettability is generally a function of the material of the surface and the material from which the droplet 430 is formed, and is specifically related to the surface tension of the liquid. Further, it is desirable that the secondary fluid 413 be relatively wetting with respect to the droplet 430 and with respect to the surfaces in the main channel 420.

Portions of the main channel 420 can be defined to be wetting, non-wetting, or to have an intermediate contact angle. For example, it may be desirable to make the portions of the main channel 420 that extends past the output contacts 422 and 424 to be less, or non-wetting to prevent the droplet 430 from entering these areas. Similarly, the portion of the main channel in the vicinity of the features 425 and 426 may be defined to create an intermediate contact angle between the droplet 430 and the main channel 420. The areas of the main channel 420 that contain the secondary fluid 413 are typically wetting to facilitate loading the secondary fluid into the main channel 420.

The liquid metal micro-switch 400 also includes one or more gaskets, as shown using reference numerals 431, 432, 434, 436, 437 and 438.

Figure 4B:
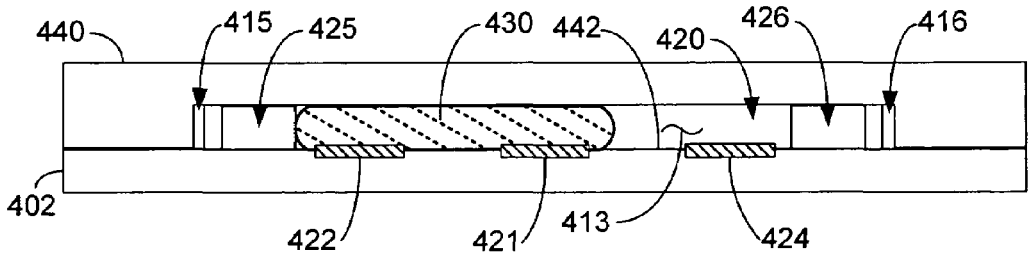
FIG. 4B is a simplified cross-sectional view through section A-A of FIG. 4A.

FIG. 4B is a simplified cross-sectional view through section A-A of FIG. 4A. The substrate 402 supports the liquid metal droplet 430 approximately as shown. The droplet 430 is in contact with the input contact 421 and the output contact 422, and rests against the feature 425. When gas pressure is exerted through the sub-channel 415, the gas 435 passes around and through portions of the feature 425, exerting pressure on the droplet 430 and causing the droplet 430 to move toward the output contact 424. Portions of the surface 442 of the substrate 402 include a material or surface treatment designed to produce an intermediate contact angle between the droplet 430 and the surface 442. An area of intermediate wettability forms an intermediate contact angle under the droplet and in the vicinity of, but not in contact with the input contact 421 and the output contacts 422 and 424. In general, the contact angle between a conductive liquid and a surface with which it is in contact ranges between 0° and 180° and is dependent upon the material from which the droplet is formed, the material of the surface with which the droplet is in contact, and is specifically related to the surface tension of the liquid. A high contact angle is formed when the droplet contacts a surface that is referred to as relatively non-wetting, or less wettable. A more wettable surface corresponds to a lower contact angle than a less wettable surface. An intermediate contact angle is one that can be defined by selection of the material covering the surface on which the droplet is in contact and is generally an angle between the high contact angle and the low contact angle corresponding to the non-wetting and wetting surfaces, respectively. If the gas pressure exerted against the droplet causes the droplet 430 to overshoot the desired position, the intermediate contact angle helps cause the droplet 430 to return to the desired position in the vicinity of, and in contact with, the output contact 422 or 424. The liquid metal micro-switch 400 also includes a cap 440, thus encapsulating the droplet 430. The cap 440 defines a fluid cavity in the main channel 420.

The area remaining within the main channel 420 is filled with a secondary fluid 413. The secondary fluid 413 is similar to the secondary fluid 313 described above and forms the atmosphere around the droplet 430. Typically, the secondary fluid 413 reduces or eliminates the formation of oxides on the surface of the droplet 430. For many gallium alloys, a secondary fluid 413 having a pH of approximately 10 will result in a hydroxyl (OH) ion terminated surface, rather than a thin native oxide terminated surface (e.g. $Ga_2O_3$), that can otherwise form and lead to the undesirable effects mentioned above.

The secondary fluid 413 also preferably possesses non-conductive dielectric characteristics so as to not interfere with the electrowetting effect that causes the droplet 430 to translate in the main channel 420. However, with an alkaline solution, there will be ionic conductivity, and this conductivity should be sufficiently small so as not to cause unacceptable leakage currents in the switch.

More generally, the secondary fluid 413 should typically have a low microwave loss tangent, enabling the secondary fluid 413 to maintain its dielectric properties at high radio frequencies. Further, the interface energy between the gallium-based droplet 430 and the secondary fluid 413 should be such that switching action can still occur. The secondary fluid 413 should also be of sufficiently low viscosity so as not to unacceptably slow switching times. The secondary fluid should be wetting with respect to the surfaces in the main channel 420, so that the secondary fluid 413 can be loaded into the switch by capillary action.

Although omitted for clarity in FIG. 4B, the main channel 420 also includes one or more vents that are used to load the liquid metal and the secondary fluid into the main channel 420. The vents can be sealed after the introduction of the liquid metal and the secondary fluid. The liquid metal can be loaded into the main channel as described in the above-mentioned co-pending, commonly-assigned published U.S. patent application No. 2006/0260919, entitled "Method and Apparatus for Filling a Microswitch with Liquid Metal." The secondary fluid is typically wetting with respect to the surfaces of the main channel 420 to facilitate loading the secondary fluid into the fluid cavity 311.

Figure 5:
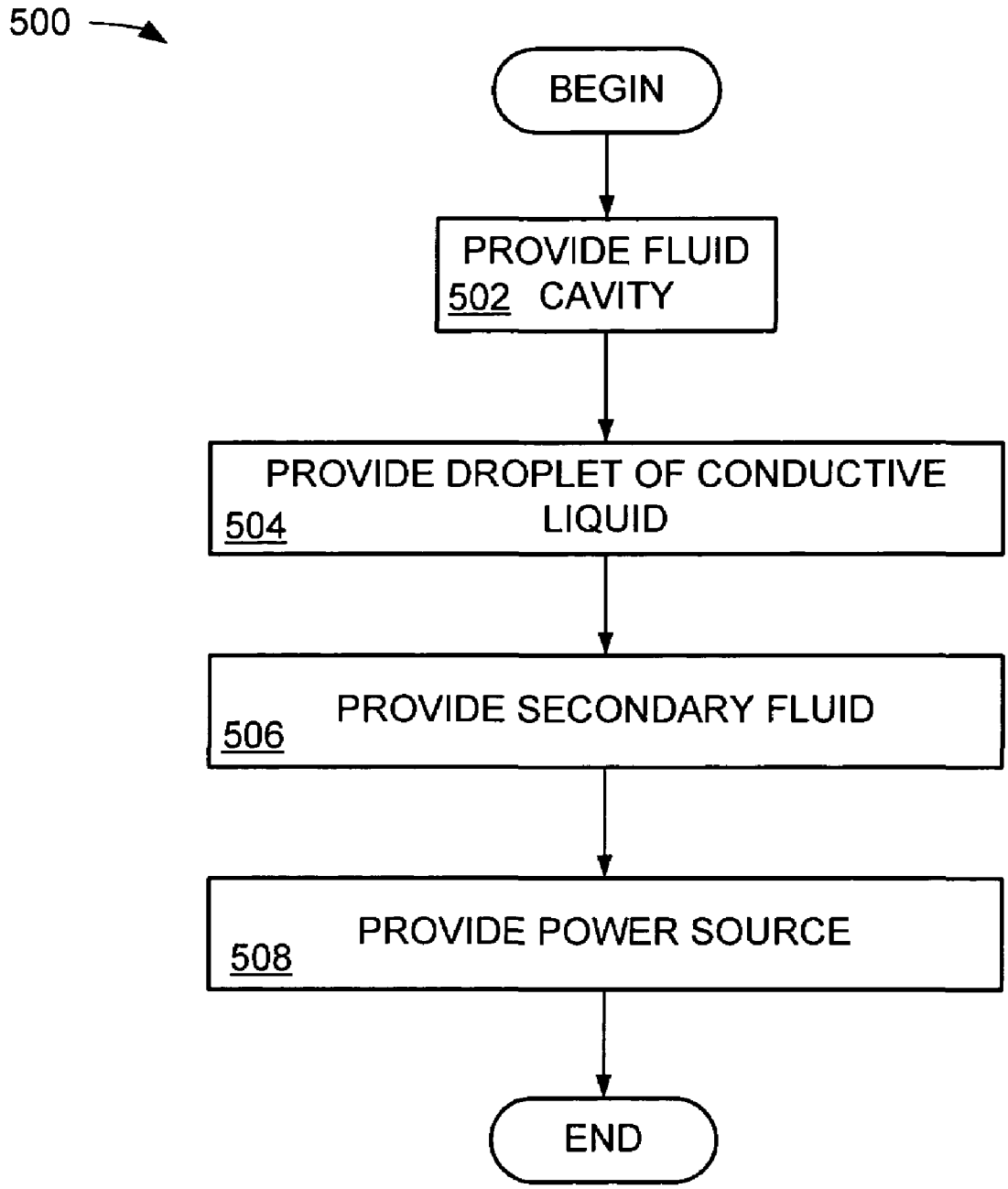
FIG. 5 is a flowchart describing a method of forming a switch according to an embodiment of the invention.

FIG. 5 is a flowchart 500 describing a method of forming a switch according to an embodiment of the invention. In block 502 a fluid cavity is provided. In block 504 a droplet of conductive liquid is provided in the fluid cavity over a substrate. The conductive liquid is a gallium-based material. In block 506, a secondary fluid is added to the fluid cavity so that it contacts and forms the atmosphere around the droplet of conductive liquid. In block 508, a power source configured to cause the conductive liquid droplet to translate in the fluid cavity is provided.

This disclosure describes embodiments in accordance with the invention in detail. However, it is to be understood that the invention defined by the appended claims is not limited to the precise embodiments described.

What is claimed is:

1. A liquid metal switch, comprising:

a conductive liquid droplet of a material containing gallium; and a secondary fluid surrounding the material containing gallium, that prevents the formation of oxide on a surface of the conductive liquid droplet, the secondary fluid having a lower viscosity than a viscosity of the conductive liquid droplet.

2. The switch of claim 1, in which the material containing gallium is chosen from gallium, indium, tin, zinc and copper.

3. A liquid metal switch, comprising:

a conductive liquid droplet of a material containing gallium, and chosen from gallium, indium, tin, zinc and copper; and a secondary fluid surrounding the material containing gallium, that prevents the formation of oxide on a surface of the conductive liquid droplet;

in which the secondary fluid has a pH sufficiently high as to have a hydroxyl (OH) ion terminated surface.

4. The switch of claim 3, further comprising:

a fluid cavity having a floor, walls and a roof; and a substrate having a surface that forms the floor, in which the secondary fluid is wetting with respect to the floor, walls and roof of the fluid cavity.

5. A liquid metal switch, comprising:

a substrate having a surface that forms a floor of a fluid cavity having the floor, and further having walls and a roof; in which the secondary fluid is wetting with respect to the floor, walls and roof of the fluid cavity;

a conductive liquid droplet disposed within the fluid cavity, the conductive liquid droplet including a material containing gallium, the material being chosen from gallium, indium, tin, zinc and copper; and a secondary fluid surrounding the material containing gallium, that prevents the formation of oxide on a surface of the conductive liquid droplet, the secondary fluid having a pH of at least 10;

in which the secondary fluid is chosen from amino alcohol triethanol amine and another organic alcohol.

6. The switch of claim 5, further comprising at least one electrode in the substrate and in which the conductive liquid droplet is caused to translate with the fluid cavity by a power source configured to create an electric circuit including the conductive liquid droplet.

7. The switch of claim 5, further comprising a heater configured to heat a gas, the heated gas expanding to cause the conductive liquid droplet to translate through the fluid cavity.

8. A method for making a switch, comprising:

providing a fluid cavity having a floor, walls and a roof;

providing a substrate having a surface that forms the floor;

providing a conductive liquid droplet of a material containing gallium located over the floor;

providing a secondary fluid surrounding the material containing gallium, the secondary fluid having a lower viscosity than a viscosity of the material containing gallium; and causing the conductive liquid droplet to translate within the fluid cavity.

9. The method of claim 8, further comprising choosing the material containing gallium from gallium, indium, tin, zinc and copper.

10. A method for making a switch, comprising:

providing a fluid cavity having a floor, walls and a roof;

providing a substrate having a surface that forms the floor;

providing a conductive liquid droplet of a material containing gallium, and chosen from gallium, indium, tin, zinc and copper, located over the floor;

providing a secondary fluid surrounding the material containing gallium; and causing the conductive liquid droplet to translate within the fluid cavity;

in which the secondary fluid has a pH sufficiently high as to have a hydroxyl (OH) ion terminated surface.

11. The method of claim 10, in which the secondary fluid is wetting with respect to the floor, walls and roof of the fluid cavity.

12. A method for making a switch, comprising:

providing a fluid cavity having a floor, walls and a roof;

providing a substrate having a surface that forms the floor;

providing a conductive liquid droplet of a material containing gallium, and chosen from gallium, indium, tin, zinc and copper, located over the floor;

providing a secondary fluid surrounding the material containing gallium the secondary fluid having a pH of at least 10, the secondary fluid being wetting with respect to the floor, walls and roof of the fluid cavity; and causing the conductive liquid droplet to translate within the fluid cavity;

in which the secondary fluid is chosen from amino alcohol triethanol amine and another organic alcohol.

13. The method of claim 12, further comprising:

providing at least one electrode in the substrate; and causing the conductive liquid droplet to translate within the fluid cavity by creating an electric circuit including the conductive liquid droplet and causing the conductive liquid droplet to translate using electrowetting.

14. The method of claim 12, further comprising causing the conductive liquid droplet to translate within the fluid cavity by heating a gas, the heated gas expanding to cause the conductive liquid droplet to translate through the fluid cavity.

15. A switch, comprising:

a fluid cavity having a floor, walls and a roof;

a substrate having a surface that forms the floor and an embedded electrode;

a conductive liquid droplet of a gallium-based alloy located in the fluid cavity over the embedded electrode;

a secondary fluid surrounding the gallium-based alloy, the secondary fluid having a lower viscosity than a viscosity of the conductive liquid droplet; and a power source configured to create an electric circuit including the conductive liquid droplet.

16. The switch of claim 15, in which the gallium based alloy is chosen from gallium, indium, tin, zinc and copper.

17. A switch, comprising:

a fluid cavity having a floor, walls and a roof;

a substrate having a surface that forms the floor and an embedded electrode;

a conductive liquid droplet of a gallium-based alloy, chosen from gallium, indium, tin, zinc and copper, located in the fluid cavity over the embedded electrode;

a secondary fluid surrounding the gallium-based alloy; and a power source configured to create an electric circuit including the conductive liquid droplet;

in which the secondary fluid has a pH sufficiently high as to have a hydroxyl (OH) ion terminated surface.

18. The switch of claim 17, in which the secondary fluid is wetting with respect to the floor, walls and roof of the fluid cavity.

19. The switch of claim 18, in which the secondary fluid captures into solution contamination that migrates to a surface of the conductive liquid droplet.

20. The switch of claim 18, in which the secondary fluid prevents oxide from forming on a surface of the conductive liquid droplet.

* * * * *